US011761672B2

(12) United States Patent
Goyal

(10) Patent No.: US 11,761,672 B2
(45) Date of Patent: Sep. 19, 2023

(54) SYSTEMS AND METHODS FOR LOCALIZED HEATING, VENTILATION, AND AIR CONDITIONING

(71) Applicant: Rheem Manufacturing Company, Atlanta, GA (US)

(72) Inventor: Ankit Goyal, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 321 days.

(21) Appl. No.: 17/342,786

(22) Filed: Jun. 9, 2021

(65) Prior Publication Data

US 2022/0397302 A1 Dec. 15, 2022

(51) Int. Cl.

| | |
|---|---|
| ***F24F 13/068*** | (2006.01) |
| ***F24F 11/70*** | (2018.01) |
| ***F24F 120/12*** | (2018.01) |

(52) U.S. Cl.

CPC ..... *F24F 13/068* (2013.01); *F24F 11/70* (2018.01); *F24F 2120/12* (2018.01); *F24F 2221/14* (2013.01); *F24F 2221/34* (2013.01); *F24F 2221/38* (2013.01)

(58) Field of Classification Search

CPC ..... F24F 11/70; F24F 13/068; F24F 2120/12; F24F 2221/14; F24F 2221/34; F24F 2221/38

USPC ..... 454/297

See application file for complete search history.

(56) References Cited

U.S. PATENT DOCUMENTS

| | | | | |
|---|---|---|---|---|
| 3,913,470 | A * | 10/1975 | Cullen | F24F 13/02 454/64 |
| 4,890,544 | A * | 1/1990 | Aalto | F24F 13/068 454/297 |
| 5,749,779 | A * | 5/1998 | Wilburn | B05B 16/60 454/67 |
| 6,099,607 | A * | 8/2000 | Haslebacher | F24F 3/163 55/482 |
| 11,486,587 | B2 * | 11/2022 | Karunanidhi | F24F 11/62 |
| 2016/0363341 | A1 * | 12/2016 | Arens | F24F 11/77 |
| 2018/0329438 | A1 * | 11/2018 | Letterman | G05B 15/02 |

* cited by examiner

*Primary Examiner* — Allen R. B. Schult

(74) *Attorney, Agent, or Firm* — Eversheds Sutherland (US) LLP

(57) ABSTRACT

An exemplary embodiment of the present disclosure provides a localized heating, ventilation, or air conditioning (HVAC) system comprising a moveable air delivery system comprising. The moveable air delivery system further comprising an air inlet configured to receive air and an air outlet configured to output the air into a space. The localized HVAC further comprising a movement system configured to move the air outlet in a generally planar manner. The movement system further comprising an air delivery support system configured to support the air outlet, the air delivery support system configured to move the air outlet in an air delivery plane.

17 Claims, 7 Drawing Sheets

SYSTEMS AND METHODS FOR LOCALIZED HEATING, VENTILATION, AND AIR CONDITIONING

FIELD OF THE DISCLOSURE

The present disclosure relates generally to heating, ventilation, and air conditioning (HVAC) systems and methods and more particularly to localized HVAC systems and methods thereto.

BACKGROUND

Reducing energy consumption is desirable. Heating, ventilation, and air conditioning (HVAC) systems can be responsible for a large portion of the energy consumed when operating a building. To address specific thermal load requirements such as an occupant in a space, a typical HVAC system must condition the entire space to address the specific requirement. That is, existing HVAC system generally condition an entire room or space, even if only a single occupant is located in that room or space. This requires the HVAC system to expend a large amount of energy to address what would otherwise be a small thermal load requirement—the portion of the space in which the occupant is located.

Additionally, the ability to target and quickly address specific thermal load requirements is desirable. Again, because existing HVAC systems must typically condition the entire space to address a specific load requirement, such systems cannot quickly respond to a change in load requirements in a specific area within the space.

Finally, the ability to target and quickly address a single and/or multiple different load requirements in a space is desirable. Typical HVAC systems utilize a sensor and/or user interface, such as a thermostat, within the space to monitor space conditions and allow users to change desired thermal conditions. But these systems often rely on a single sensor that monitors and relays the thermal load requirements for an entire space associated with the single sensor.

Therefore, what is needed is a localized HVAC system that is capable of specifically and efficiently targeting one or more areas within a space to address specific and/or local thermal load requirements. This and other problems are addressed by the technology disclosed herein.

SUMMARY

The present disclosure relates to a localized HVAC system. The disclosed technology includes a localized heating, ventilation, or air conditioning (HVAC) system. The localized HVAC system can include a moveable air delivery system and a movement system. The moveable air delivery system can include an air inlet and an air outlet. The air inlet can be configured to receive air. The air outlet can be configured to output the air into a space. The movement system can be configured to move the air outlet in a generally planar manner. The movement system can include an air delivery support system. The air delivery support system can be configured to support the air outlet. The air delivery support system can be configured to move the air outlet in an air delivery plane.

The localized HVAC system can include a fan. The fan can be configured to move the air into the space through the air outlet.

The movement system can include a first slider and a second slider. The first slider can be moveable along at least a portion of the air delivery plane in a first linear direction. The second slider can be moveable along at least a portion of the air delivery plane in a second linear direction. The second linear direction can be generally perpendicular to the first linear direction. The first and second slider can be configured to move the air outlet within the air delivery plane.

The air delivery support system can include a first track and a second track. The first track can be configured to guide the first slider along at least a portion of the air delivery plane in the first linear direction. The second track can be configured to guide the second slider along at least a portion of the air delivery plane in the second linear direction.

The movement system can include the air outlet attached thereto. The movement system can be configured to move the air outlet between a plurality of locations on the air delivery support system in two degrees of freedom within the air delivery plane.

The movement system can be configured to move along a generally horizontal plane.

The localized HVAC system can include a false ceiling. The false ceiling can include a barrier to substantially separate the movement system from the space. The false ceiling can be disposed below the air delivery plane. The false ceiling can include one or more openings to allow air to pass from the air outlet of the moveable air delivery system to the space.

The false ceiling can include one or more air dampers. The one or more air dampers can be configured to control air flow from the air outlet of the moveable air delivery system to the space by the one or more air dampers configured to bias closed and the one or more air dampers configured to open when the air outlet of the moveable air delivery system is positioned above the one or more air dampers.

The movement system can be configured to move along a generally vertical plane.

The localized HVAC system can include a false wall. The false wall can include a barrier to substantially separate the movement system from the space. The false wall can be disposed adjacent to the air delivery plane. The false wall can include one or more openings to allow air to pass from the air outlet of the moveable air delivery system to the space.

The false wall can include one or more air dampers. The one or more air dampers can be configured to control air flow from the air outlet of the moveable air delivery system to the space by the one or more air dampers configured to bias closed and the one or more air dampers configured to open when the air outlet of the moveable air delivery system is positioned adjacent to the one or more air dampers.

The localized HVAC system can include a controller. The controller can be configured to move the air outlet within the air delivery plane.

The localized HVAC system can include a sensor.

The controller can be configured to receive user location data from the sensor. The user location data can indicate a current location of a user in the space. The controller can be configured to determine a position corresponding to the current location of a user in the space. The controller can be configured to output instructing for the movement system to move the air outlet to the position.

The air inlet can be configured to receive air through a duct.

The air inlet can be configured to receive air through a pressurized plenum.

The disclosed technology includes a localized heating, ventilation, or air conditioning (HVAC) system. The localized HVAC system can include a moveable thermal delivery system and a movement system. The moveable thermal delivery system can include a radiant thermal source. The movement system can be configured to move the radiant thermal source in a generally planar manner. The movement system can include a radiant support system. The radiant support system can be configured to support the radiant thermal source. The radiant support system can be configured to move the radiant thermal source in a radiant delivery plane.

The radiant thermal source can be an electric heating coil.

The radiant thermal source can be a chilled beam.

The disclosed technology includes a localized heating, ventilation, or air conditioning (HVAC) system. The localized HVAC system can include a first moveable air delivery system, a first movement system, a second moveable air delivery system, and a second movement system. The first moveable air delivery system can include a first air inlet and a first air outlet. The first air inlet can be configured to receive air. The first air outlet can be configured to output the air into a space. The first movement system can be configured to move the first air outlet in a generally planar manner. The first movement system can include a first air delivery support system. The first air delivery support system can be configured to support the first air outlet. The first air delivery support system can be configured to move the first air outlet in a generally horizontal air delivery plane. The second moveable air delivery system can include a second air inlet and a second air outlet. The second air inlet can be configured to receive air. The second air outlet can be configured to output the air into a space. The second movement system can be configured to move the second air outlet in a generally planar manner. The second movement system can include a second air delivery support system. The second air delivery support system can be configured to support the second air outlet. The second air delivery support system can be configured to move the second air outlet in a generally vertical air delivery plane.

These and other aspects of the present disclosure are described in the Detailed Description below and the accompanying drawings. Other aspects and features of embodiments will become apparent to those of ordinary skill in the art upon reviewing the following description of specific, exemplary embodiments in concert with the drawings. While features of the present disclosure may be discussed relative to certain embodiments and figures, all embodiments of the present disclosure can include one or more of the features discussed herein. Further, while one or more embodiments may be discussed as having certain advantageous features, one or more of such features can also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

The following detailed description of specific embodiments of the disclosure will be better understood when read in conjunction with the appended drawings. For the purpose of illustrating the disclosure, specific embodiments are shown in the drawings. It should be understood, however, that the disclosure is not limited to the precise arrangements and instrumentalities of the embodiments shown in the drawings.

DETAILED DESCRIPTION

Figure 1:
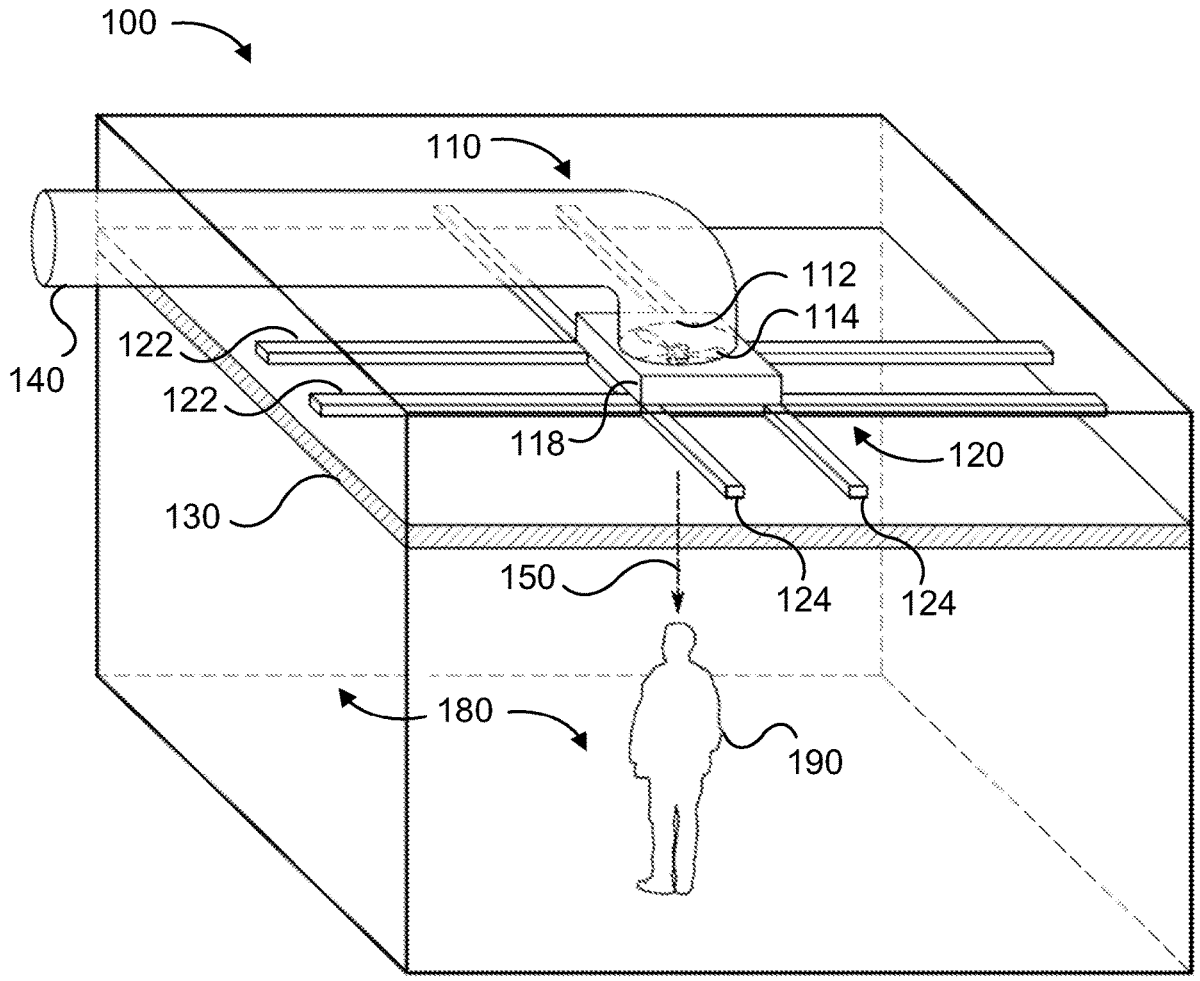
FIG. 1 provides an isometric view of an example localized HVAC system, in accordance with the present disclosure.

Throughout this disclosure we describe a localized heating, ventilation, and air conditioning (HVAC) system. For example, a localized HVAC system that can track a user's location within a space and move an air delivery system to provide conditioned air to the user's location. As such, the localized HVAC system can make a user comfortable by targeting the user's location and avoid conditioning unoccupied space.

While the disclosed technology is described throughout this disclosure in relation to HVAC applications, those having skill in the art will recognize that the disclosed technology is not so limited and can be applicable to other scenarios and applications. For example, it is contemplated that the disclosed technology can be applicable to any lighting system, such as task lighting applications.

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Indeed, it is to be understood that other examples are contemplated. Many suitable components that would perform the same or similar functions as components described herein are intended to be embraced within the scope of the disclosed electronic devices and methods. Such other components not described herein may include, but are not limited to, for example, components developed after development of the disclosed technology.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified. Further, it is contemplated that the disclosed methods and processes can include, but do not necessarily include, all steps discussed herein. That is, methods and processes in accordance with the disclosed technology can include some of the disclosed while omitting others.

Throughout the specification and the claims, the following terms take at least the meanings explicitly associated herein, unless otherwise indicated. The term "or" is intended to mean an inclusive "or." Further, the terms "a," "an," and "the" are intended to mean one or more unless specified otherwise or clear from the context to be directed to a singular form. By "comprising," "containing," or "including" it is meant that at least the named element, or method step is present in article or method, but does not exclude the presence of other elements or method steps, even if the other such elements or method steps have the same function as what is named.

As used herein, unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Although the disclosed technology may be described herein with respect to various systems and methods, it is contemplated that embodiments or implementations of the disclosed technology with identical or substantially similar features may alternatively be implemented as methods or systems. For example, any aspects, elements, features, or the like described herein with respect to a method can be equally attributable to a system. As another example, any aspects, elements, features, or the like described herein with respect to a system can be equally attributable to a method.

Reference will now be made in detail to examples of the disclosed technology, examples of which are illustrated in the accompanying drawings and disclosed herein. Wherever convenient, the same reference numbers will be used throughout the drawings to refer to the same or like parts.

Referring now to the drawings, in which like numerals represent like elements, examples of the present disclosure are herein described. As will be described in greater detail, the present disclosure can include a system and method for providing localized HVAC. To provide a background of the system described in the present disclosure, components of the localized HVAC system are shown in FIGS. 1, 2, 3, and 4 and will be discussed first.

To facilitate an understanding of the principles and features of the present disclosure, various examples of the disclosed technology are explained herein. The components, steps, and materials described herein as making up various elements of the disclosed technology are intended to be illustrative and not restrictive. Many suitable components, steps, and materials that would perform the same or similar functions as the components, steps, and materials described herein are intended to be embraced within the scope of the disclosure. Such other components, steps, and materials not described herein can include, but are not limited to, similar components or steps that are developed after development of the embodiments disclosed herein.

The conditioning of the space can include heating, cooling, dehumidifying, humidifying, air movement, or any combination thereof. Unless otherwise indicated "conditioned air" refers to air that has been heated, cooled, humidified, dehumidified, moved, or any combination thereof.

As used herein, unless otherwise noted, the terms "space" and "room" are used interchangeably to reference a conditioned space (e.g., by cooling, heating, and/or air movement) that is bounded by at least one wall and/or a ceiling. For example, the "space" and "room" can be an enclosed space such as an office, bedroom, kitchen, etc. Alternatively, or in addition, the "space" and "room" can be an open space such as a corridor, auditorium, open office, gymnasium, grocery store, etc. The "space" and "room" contemplated by the disclosure need not necessarily be "indoors," although it can. For example, the disclosed technology can include an air movement system incorporated into a ceiling of an open air structure, where the air movement system is not necessarily in communication with an air conditioning or heating system but can nonetheless provide conditioning and/or air flow to a current location of an occupant.

As shown in FIG. 1, the disclosed technology includes a localized heating, ventilation, and air conditioning (HVAC) system 100. The localized HVAC system 100 can include a moveable air delivery system 110, and as explained more fully herein, the moveable air delivery system 110 can be configured to condition a local space within a larger space (e.g., a room). For example, the localized HVAC system 100 can be configured to track the location of an occupant within the space and can move the moveable air delivery system 110 to follow the movement of the occupant within the space. In such a manner, the localized HVAC system 100 can condition only the volume within the general space that is currently occupied by the occupant, which can provide significant energy savings by not conditioning the space in its entirety.

The moveable air delivery system 110 can be configured to receive air (e.g., from a central HVAC system) and move the air to a target location within the space using, for example, a fan 114. The fan 114 can be attached to a movement system 120, which is described more fully herein.

The moveable air delivery system 110 can include an air inlet 112 for receiving air from the central HVAC system. By way of example, the air inlet 112 can be or include a collar designed to receive a duct 140. For example, the duct 140 can be connected to the central HVAC system and provide conditioned air from the central HVAC system, through the duct 140, to the air inlet 112. The duct 140 can include a portion of which the duct is flexible. For example, a section of the duct 140 can be flexible duct. The moveable air delivery system 110 can optionally omit the duct 140. For example, the moveable air delivery system 110 can be configured to receive air from the central HVAC system via a plenum and can force air from the plenum toward the target location within the space via the fan 114. Alternatively, or in addition, the moveable air delivery system 110 can be configured to push/pull air to/from a space 180 to provide ventilation. For example, the air delivery system can omit being configured to receive air from the central HVAC system and simply provide ventilation through supplying and/or exhausting air to/from the space 180.

The moveable air delivery system 110 can include an air outlet. By way of example, the air outlet can be an opening disposed downstream of the air inlet 112. The air outlet can be configured to provide supply air 150 to a space 180.

The fan 114 can include any fan known in the art, including, but not limited to, axial, centrifugal, and the like, and any combination thereof. Optionally, the fan 114 can be a variable speed fan to allow for the variable airflow. The fan 114 can be disposed downstream of the air inlet 112 and upstream of the air outlet. For example, the fan 114 can be configured to move supply air 150, received through the air inlet 112, out through the air outlet into the space 180.

The localized HVAC system 100 can include a movement system 120. The movement system 120 can be designed to move the moveable air delivery system 110 to a plurality of locations. For example, the movement system 120 can move the moveable air delivery system 110 to different locations at which the moveable air delivery system 110 can provide supply air 150 to a targeted location within the space 180. The movement system 120 can include an air delivery support system configured in a generally planar configuration that defines a two-dimensional air delivery plane. The movement system 120 can move the moveable air delivery system 110 to multiple different locations along the two-dimensional air delivery plane. For example, the air delivery support system can be affixed or supported by a building's structure to then support the moveable air delivery system 110. As illustrated, the air delivery support system of the movement system 120 can support the fan housing 118 and can be configured to move the fan 114 between a plurality of locations on the air delivery support system in two degrees of freedom within the air delivery plane. The air delivery support system can be configured such that it defines an air delivery plane whose boundaries generally match those of the space 180. Alternatively, the air delivery support system can have dimensions that are smaller than those of the space.

The movement system 120 can move the moveable air delivery system 110 along a two-dimensional air delivery plane via one or more tracks and one or more sliders. For example, the moveable air system can move, via sliders, along a track in a first linear direction. Additionally, the track on which the moveable air delivery system moves can also move, via sliders, along another track in a second linear direction that is perpendicular to the first linear direction.

The movement system 120 can comprise one or more tracks 122, 124 to facilitate moving the moveable air delivery system 110 between a plurality of locations on the air delivery plane. For example, the one or more tracks 122, 124 can form the air delivery support system. The one or more tracks can be any elongated member. For example, the one or more tracks can be any elongated member known in the art, including, but not limited to, a beam, wire, rod, rail, and the like, or any combination thereof. The one or more tracks can include one or more elongated members. For example, each track can include two elongated members. Each pair of elongate members can be generally parallel. The two elongated members of the track can be spaced apart at any distance. For example, the two elongated members of the first track can be spaced apart the width of the fan housing 118 and the two elongated members of the second track 124 can be spaced apart the length of the fan housing 118. Alternatively, the second track 124 can be spaced apart a length of the air delivery support plane (e.g., the length of the room). Alternatively, or in addition, the one or more tracks 122, 124 can be slidably anchored to a wall.

The movement system 120 can include a first track 122 that runs a length of the air delivery support plane and a second track 124 that runs a width of the air delivery support plane. For example, the first track 122 can be generally perpendicular to the second track 124.

The movement system 120 can include one or more sliders to facilitate moving the moveable air delivery system 110 between a plurality of locations on the air delivery plane. By way of example, the one or more sliders can be any type of movement mechanism, for example, wheels, rollers, gears, low friction materials, and the like, or any combination thereof.

The movement system 120 can include a first slider moveable along at least a portion of the air delivery plane in a first linear direction. Additionally, the movement system 120 can include a second slider moveable along at least a portion of the air delivery plane in a second linear direction. For example, the second linear direction can be generally perpendicular to the first linear direction. Alternatively, or in addition, the first and second sliders can each be one or more sliders. For example, the first and second slider can each comprise two sliders, each slider configured to interact with the two elongated members of the one or more tracks 122, 124.

The one or more sliders can be configured to interact with the one or more tracks 122, 124. For example, the first track 122 can be configured to guide the first slider along at least a portion of the air delivery plane in the first linear direction. The second track 124 can be configured to guide the second slider along at least a portion of the air delivery plane in the second linear direction.

The first slider can be configured to interact with the moveable air delivery system 110. For example, the first slider can be attached to a portion of the moveable air delivery system 110 (e.g., the fan housing 118). The first slider can move the fan 114 along the first track 122 in a first linear direction. Additionally, the second slider can be configured to interact with the first track 122. For example, the second slider can be attached to the first track 122. The second slider can move the first track 122 along the second track 124 in a second linear direction.

The movement system 120 can include one or more movement motors 560 to facilitate moving the moveable air delivery system 110. The movement motors 560 can be any motor known in the art, including, but not limited to a servo motor, DC motor, AC motor, brushless motor, direct drive motor, and the like, and any combination thereof. The movement motors 560 can move the moveable air delivery system 110, via the first slider, along the first track 122 and move the first track 122, via the second slider, along the second track 124. For example, the one or more sliders can each include a wheel to facilitate moving along the tracks, the movement motors 560 can turn the wheel to move the sliders in a first and second direction on the track (e.g., forward and reverse).

The localized HVAC system 100 can include a false ceiling 130. For example, the false ceiling 130 can be disposed below the air delivery plane defined by the air delivery support system of the movement system 120. The false ceiling 130 can be permeable to allow supply air 150 to pass through the false ceiling 130. For example, the false ceiling can include one or more openings to allow supply air 150 to pass from the moveable air delivery system 110, through the false ceiling 130, and into the space 180.

As shown in FIG. 1 the movement system 120 can include a plurality of tracks and sliders. Alternatively, or in addition, the movement system 120 can include one or more guide wires, pulleys, motors, gears, wheels, gear racks, rack and pinion, bearings, guide rails, winches, and the like, or any combination thereof. By way of example, the movement system 120 can be a cable-suspended movement system that includes guide wires and winches to move the moveable air delivery system 110.

Figure 2:
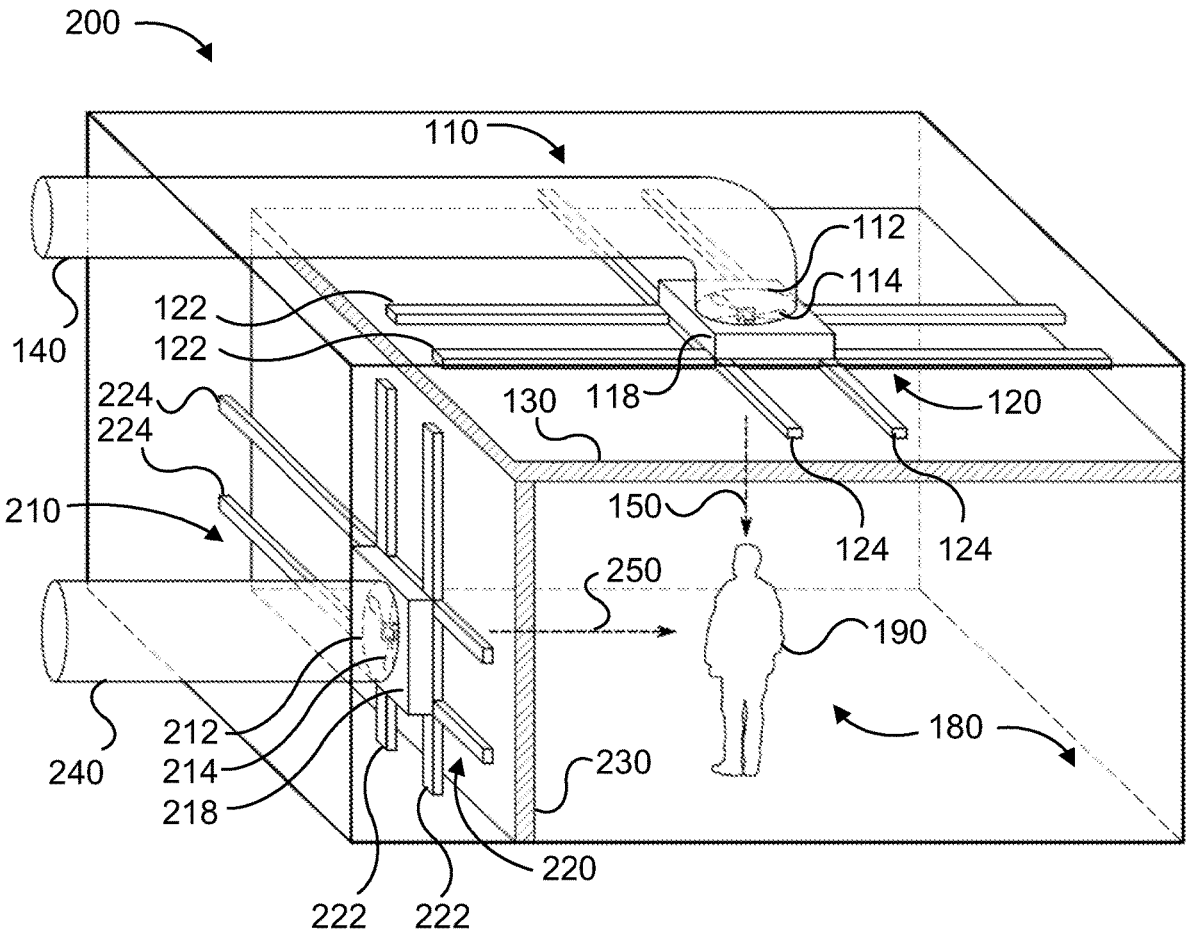
FIG. 2 provides an isometric view of an example localized HVAC system, in accordance with the present disclosure.

As shown in FIG. 2, the disclosed technology includes a localized heating, ventilation, or air conditioning (HVAC) system 200. The localized HVAC system 200 can include an air delivery system disposed within a wall of the space. Optionally, the localized HVAC system 200 can also include an overhead air delivery system as described with respect to FIG. 1. As will be understood disclosed technology can include a wall system only. For example, the localized HVAC system 200 can include a moveable air delivery system 210 disposed within a wall. Optionally, the localized HVAC system 200 can include both an overhead moveable air delivery system and one or more moveable air delivery system disposed within a wall of the space. For example, the localized HVAC system 200 can include a moveable air delivery system 110 disposed overhead and a moveable air delivery system 210 disposed within a wall. Alternatively, or in addition, the localized HVAC system 200 can include a moveable air delivery system 110 disposed overhead and within a wall. For example, the moveable air delivery system can be capable of moving back and forth from horizontally overhead a space 180 (e.g., above a ceiling) to vertically adjacent to a space 180 (e.g., within a wall).

The moveable air delivery system 210 can include an air inlet 212. By way of example the air inlet 212 can be or include a collar designed to receive a duct 240. For example, the duct 240 can be connected to a central HVAC system and provide conditioned air from the central HVAC system, through the duct 240, to the air inlet 212. The duct 240 can include a portion of which the duct is flexible. For example, a section of the duct 240 can be flexible duct.

The moveable air delivery system 210 can include an air outlet. By way of example, the air outlet can be an opening disposed downstream of the air inlet 212. The air outlet can be configured to provide supply air 250 to a space 180.

The moveable air delivery system 210 can include a fan 214. The fan 214 can include any fan known in the art, including, but not limited to, axial, centrifugal, and the like, and any combination thereof. Additionally, the fan 214 can be a variable speed fan to allow for the variable airflow. The fan 214 can be disposed downstream of the air inlet 212 and upstream of the air outlet. For example, the fan 214 can be configured to move supply air 250, received through the air inlet 212, out through the air outlet into the space 180.

The localized HVAC system 200 can include a movement system 220. Alternatively, or in addition, the localized HVAC system 200 can include a movement system 120 to move a moveable air delivery system 110 as described with respect to FIG. 1. Although FIG. 2 illustrates the localized HVAC system 200 as having both a moveable air delivery system 110 that is overhead and a moveable air delivery system 210 that is within a wall, it is contemplated herein that the localized HVAC system 200 can (i) include the moveable air delivery system 210 within the wall while omitting the overhead moveable air delivery system 110 and/or (ii) include multiple moveable air delivery system 210 within multiple corresponding walls for a given room.

The movement system 220 can be designed to move the moveable air delivery system 210 to a plurality of locations. For example, the movement system 220 can move the moveable air delivery system 210 to different locations at which the moveable air delivery system 210 can provide supply air 250 to a targeted location within the space 180. The movement system 220 can include an air delivery support system configured in a generally planar configuration that defines a two-dimensional air delivery plane. The movement system 220 can move the moveable air delivery system 210 to multiple different locations along the two-dimensional air delivery plane. For example, the air delivery support system can be affixed or supported by a building's structure to then support the moveable air delivery system 210. As illustrated, the air delivery support system of the movement system 220 can support the fan housing 218 and can be configured to move the fan 214 between a plurality of locations on the air delivery support system in two degrees of freedom within the air delivery plane. The air delivery support system can be configured such that it defines an air delivery plane whose boundaries generally match those of a wall of the space 180. Alternatively, the air delivery support system can have dimensions that are smaller than those of the wall of the space.

The movement system 220 can move the moveable air delivery system 210 along the two-dimensional air delivery plane via one or more tracks and one or more sliders. For example, the moveable air delivery system 210 can move, via sliders, along a track in a first linear direction. Additionally, the track on which the moveable air delivery system 210 moves can also move, via sliders, along another track in a second linear direction that is perpendicular to the first linear direction.

The movement system 220 can comprise one or more tracks 222, 224 to facilitate moving the moveable air delivery system 210 between a plurality of locations on the air delivery plane. For example, the one or more tracks 222, 224 can form the air delivery support system. The one or more tracks can be any elongated member. For example, the one or more tracks can be any elongated member known in the art, including, but not limited to, a beam, wire, rod, rail, and the like, or any combination thereof. The one or more tracks can include one or more elongated members. For example, each track can include two elongated members. Each pair of elongate members can be generally parallel. The two elongated members of the track can be spaced apart at any distance. For example, the two elongated members of the first track 222 can be spaced apart the width of the fan housing 218 and the two elongated members of the second track 224 can be spaced apart the length of the fan housing 218. Alternatively, the second track 224 can be spaced apart a length of the air delivery support plane (e.g., the length of the room). Alternatively, or in addition, the one or more tracks 222, 224 can be slidably anchored to a wall.

The movement system 220 can include a first track 222 that runs a length of the air delivery support plane and a second track 224 that runs a width of the air delivery support plane. For example, the first track 222 can be generally perpendicular to the second track 224.

The movement system 220 can include one or more sliders to facilitate moving the moveable air delivery system 210 between a plurality of locations on the air delivery plane. By way of example, the one or more sliders can be any type of movement mechanism, for example, wheels, rollers, gears, low friction materials, and the like, or any combination thereof.

The movement system 220 can include a first slider moveable along at least a portion of the air delivery plane in a first linear direction. Additionally, the movement system 220 can include a second slider moveable along at least a portion of the air delivery plane in a second linear direction. For example, the second linear direction can be generally perpendicular to the first linear direction. Alternatively, or in addition, the first and second sliders can each be one or more sliders. For example, the first and second slider can each comprise two sliders, each slider configured to interact with the two elongated members of the one or more tracks 222, 224.

The one or more sliders can be configured to interact with the one or more tracks 222, 224. For example, the first track 222 can be configured to guide the first slider along at least a portion of the air delivery plane in the first linear direction. The second track 224 can be configured to guide the second slider along at least a portion of the air delivery plane in the second linear direction.

The first slider can be configured to interact with the moveable air delivery system 210. For example, the first slider can be attached to a portion of the moveable air delivery system 210 (e.g., the fan housing 218). The first slider can move the fan 214 along the first track 222 in a first linear direction. Additionally, the second slider can be configured to interact with the first track 222. For example, the second slider can be attached to the first track 222. The second slider can move the first track 222 along the second track 224 in a second linear direction.

The movement system 220 can include one or more movement motors 560 to facilitate moving the moveable air delivery system 210. The movement motors 560 can be any motor known in the art, including, but not limited to a servo motor, DC motor, AC motor, brushless motor, direct drive motor, and the like, and any combination thereof. The movement motors 560 can move the moveable air system, via the first slider, along the first track 222 and move the first track 222, via the second slider, along the second track 224. For example, the one or more sliders can each include a wheel to facilitate moving along the tracks, the movement motors 560 can turn the wheel to move the sliders in a first and second direction on the track (e.g., forward and reverse).

The localized HVAC system 200 can include a false wall 230. For example, the false wall 230 can be disposed adjacent to the air delivery plane defined by the air delivery support system of the movement system 220. The false wall 230 can be permeable to allow supply air 250 to pass through the false wall 230. For example, the false wall 230 can include one or more openings to allow supply air 250 to pass from the moveable air delivery system 210, through the false wall 230, and into the space 180.

As shown in FIG. 2 the movement system 220 can include a plurality of tracks and sliders. Alternatively, or in addition, the movement system 220 can include one or more guide wires, pulleys, motors, gears, wheels, gear racks, rack and pinion, bearings, guide rails, winches, and the like, or any combination thereof. By way of example, the movement system 220 can be a cable-suspended movement system that includes guide wires and winches to move the moveable air delivery system 210.

Figure 3:
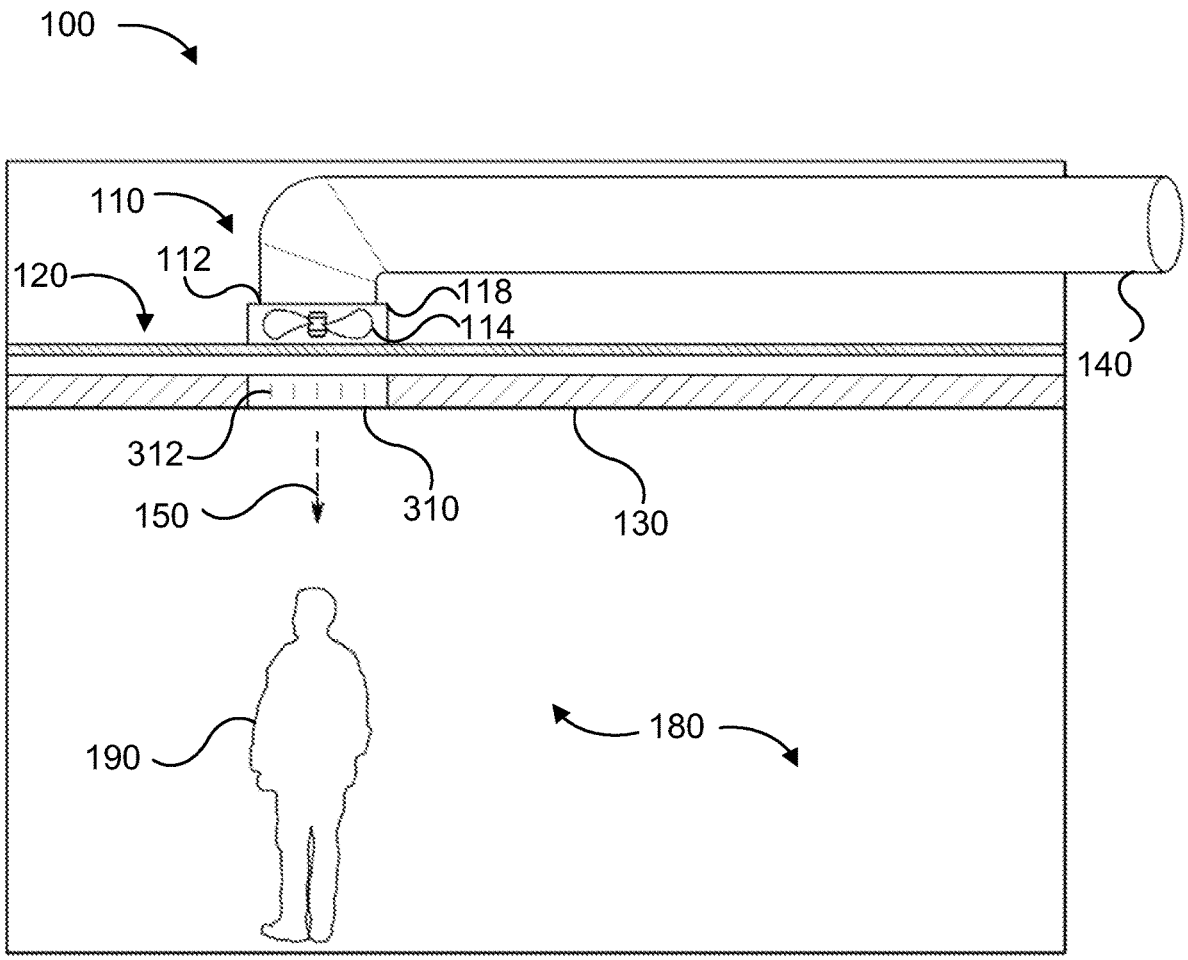
FIG. 3 provides an elevation view of an example localized HVAC system, in accordance with the present disclosure.

As shown in FIG. 3, the false ceiling 130 can include one or more openings to allow supply air 150 to pass from the moveable air delivery system 110, through the false ceiling 130, and into the space 180. Alternatively, or in addition, the localized HVAC system 100 can include one or more air dampers 310. For example, the false ceiling 130 can include one or more air dampers 310 configured to control air flow from the air outlet of the moveable air delivery system 110 to the space 180. Each air dampers 310 can be configured to bias closed to passively prevent airflow through the air damper 310. The air dampers 310 can be configured to open when activated to allow airflow through the air damper 310. For example, the air damper can be activated to open when the air outlet of the moveable air delivery system 110 is positioned above the air damper 310. The air damper 310 can be automatically activated to open by the differential in air pressure caused by the airflow from the air outlet of the moveable air delivery system 110. For example, the air damper 310 can include a spring member that can passively exert a force on the damper to be in a closed position. The spring member can exert a force that can be overcome by the differential air pressure caused by the supply air from the moveable air delivery system 110 to allow the air damper 310 to open. Alternatively, or in addition, the air damper can include a gravity damper. For example, the gravity damper can passively be in a closed position through gravity exerting a force on the damper. The force from gravity on the damper can be overcome by the differential air pressure caused by the supply air from the moveable air delivery system 110 to allow the air damper 310 to open. Alternatively, or in addition, the air damper 310 can be activated to open by an actuator. For example, the air damper 310 can be a motorized air damper with a damper motor 570 for opening and closing the air damper 310. The air damper 310 can have one or more blades 312. For example, the blades 312 can be positioned as to prevent airflow through the air damper 310 when closed, and to allow airflow through the air damper 310 when opened. Additionally, the blades 312 can further be arranged to direct the supply air 150 into the space 180 at a desired angle.

As will be understood, the false wall 230 can alternatively, or in addition, include one or more air dampers 310, as described with respect to FIG. 3, configured to control air flow from the air outlet of the moveable air delivery system 210 to the space 180.

Figure 4:
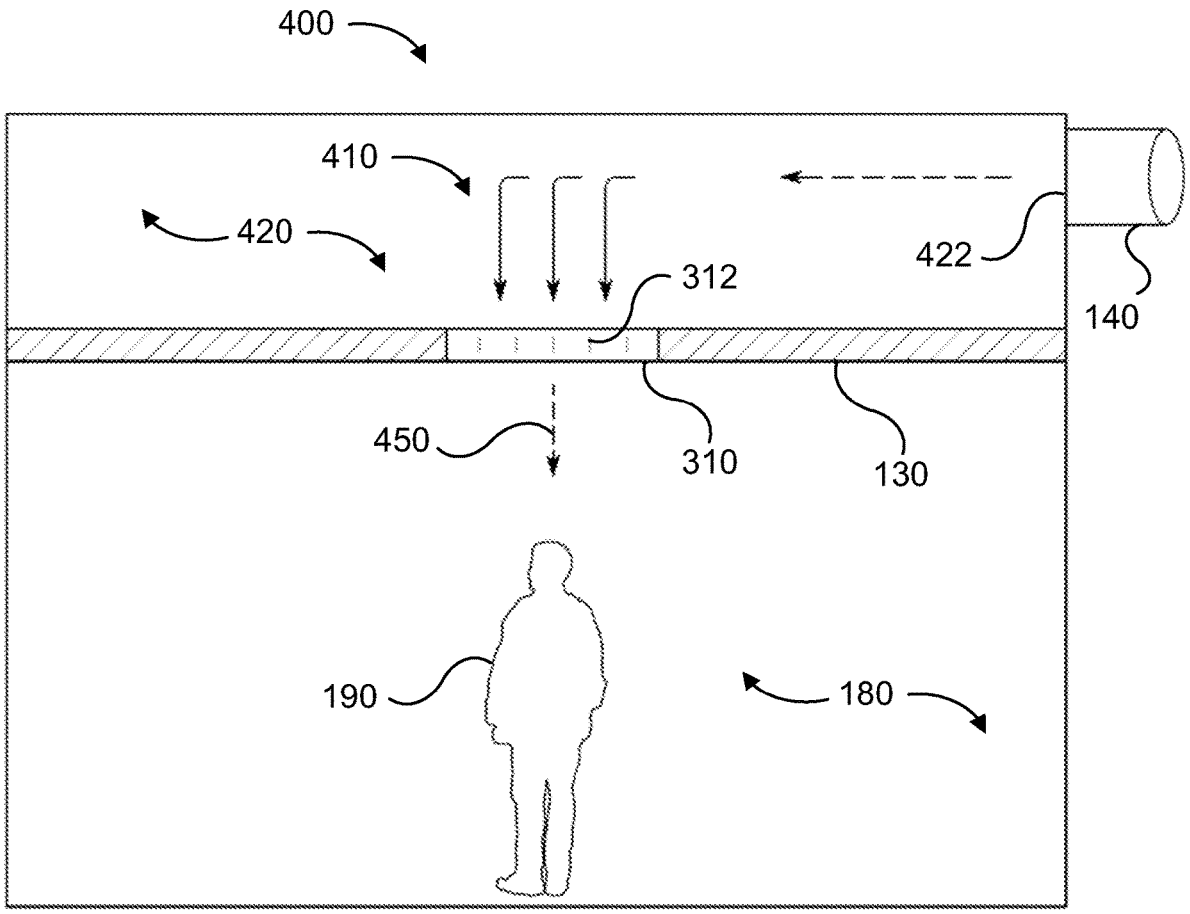
FIG. 4 provides an elevation view of an example localized HVAC system, in accordance with the present disclosure.

While the technology has been described here to include a fan, ductwork, and a movement system, the technology is not so limiting. As shown in FIG. 4, the localized HVAC system can optionally omit the fan, ductwork, and/or movement system. As shown in FIG. 4, the disclosed technology includes a localized heating, ventilation, or air conditioning (HVAC) system 400. The localized HVAC system 400 can include a plenum air delivery system 410. By way of example, the plenum air delivery system can have a plenum 420 and a plenum air inlet 422. The plenum 420 can be configured to be pressurized by air from the plenum air inlet 422. For example, the plenum air inlet 422 can be connected to a central HVAC system which provide conditioned air to the plenum 420 through the plenum air inlet 422. The plenum air inlet 422 can be connected to a central HVAC system by a duct 140.

The localized HVAC system 400 can include a false ceiling 130. For example, the false ceiling 130 can be disposed below the plenum 420. The false ceiling 130 can be permeable to allow supply air 450 to pass through the false ceiling 130. For example, the false ceiling can include one or more openings to allow supply air 450 to pass from the plenum 420, through the false ceiling 130, and into the space 180.

The localized HVAC system 400 can include one or more air dampers 310. For example, the false ceiling 130 can include one or more air dampers 310 configured to control air flow from plenum 420 to the space 180. Each air dampers 310 can be configured to bias closed to passively prevent airflow through the air damper 310. Additionally, the air damper 310 can be configured to open when activated to allow airflow through the air damper 310. For example, the air damper 310 closest to the occupant can open to condition the space around the occupant. The air damper 310 can be activated to open by an actuator. For example, the air damper 310 can be a motorized air damper with a damper motor 570 for opening and closing the air damper 310. The air damper 310 can have one or more blades 312. For example, the blades 312 can be positioned as to prevent airflow through the air damper 310 when closed, and to allow airflow through the air damper 310 when opened. Additionally, the blades 312 can further be arranged to direct the supply air 150 into the space 180 at a desired angle.

Alternatively, or in addition, the plenum air delivery system 410 can include a moveable air delivery system as described with respect to FIGS. 1 and 2. The moveable air delivery system can be located in the plenum 420. The moveable air delivery system can include an air inlet. By way of example the air inlet can be an opening designed to allow airflow from the plenum 420 into the moveable air delivery system.

While FIG. 4 illustrates the localized HVAC system 400 as an overhead system, the localized HVAC system 400 can additionally or alternatively be installed as a wall. In such a case, a plenum would be situated behind a false wall (e.g., false wall 230) in the same or similar fashion as the plenum 420 is shown in FIG. 4 as being behind (i.e., above) the false ceiling 130.

Alternatively, or in addition, the disclosed technology can include a radiant thermal source. For example, the moveable air delivery system of the localized HVAC system 100, 200, and/or 400 can include a radiant thermal source. The radiant thermal source can provide radiant type heating and/or cooling to a space. For example, the radiant thermal source can be any radiant thermal source known in the art, including, but not limited to, electric coils, gas fired heater, chilled beams, heating hot water coils, chilled water coils, and the like, and any combination thereof. The radiant thermal source can provide localized heating and cooling alternatively, or in addition to, conditioned air from a central HVAC system. Optionally, the moveable air delivery system can include a radiant thermal source and omit a fan for passive heating and cooling.

Alternatively, or in addition, the disclosed technology can include a plurality of localized HVAC systems 100, 200, and/or 400 that each serve a predetermined portion of a space (e.g., one localized HVAC system for each quadrant of a space). For example, the space can be served by a plurality of localized HVAC systems 100, 200, and/or 400 each located proximate to a different quadrant of a space (e.g., a localized HVAC system located above each section or quadrant of the ceiling and/or a localized HVAC system located at one, some, all, (or a corresponding portion(s) or section(s)) of the walls of a space). Each of the plurality of localized HVAC systems 100, 200, and/or 400 can be configured to operate independently. Alternatively, or in addition, the plurality of localized HVAC systems 100, 200, and/or 400 can be controlled by a central control system. For example, the plurality of localized HVAC systems 100, 200, and/or 400 can communicate and coordinate to quickly and efficiently address localized thermal demands in the space. The plurality of localized HVAC systems 100, 200, and/or 400 can each track one or more persons within a space and can provide simultaneous localized conditioning at the location of one or more persons within the space.

The localized HVAC systems disclosed herein can further include one or more sensors. For example, the HVAC delivery system can include one or more thermal sensors capable of sensing the thermal conditions in the space. The one or more thermal sensors can include any thermal sensors known in the art, including, but not limited to, thermostat, humidistat, dry bulb sensor, wet bulb sensor, infrared temperature sensor, and the like, and any combination thereof. By way of example, the one or more thermal sensors can be located in multiple locations within a space (e.g., wall, ceiling, cubicle, workstation) to sense the thermal conditions in multiple locations within a space. Alternatively, or in addition, the one or more thermal sensors can be attached to the localized HVAC system. For example, the one or more thermal sensors can move with the moveable air delivery system to a plurality of locations withing the space. Alternatively, or in addition, the one or more sensors can include sensors configured to detect the presence of one or more occupants 190 in a space. For example, the occupant 190 can be a human. Alternatively, or in addition, the occupant 190 can be any thermal energy emitting or absorbing source such as a pet, electronic, machinery, computer, appliance, open air displays (e.g., grocery store refrigerated vegetable and meat displays), and the like, or any combination thereof. The one or more occupant sensors can include any detection sensors known in the art, including, but not limited to an occupant sensor, camera, motion detector, infrared sensor, thermal sensor, and the like, or any combination thereof. By way of example, the one or more occupant sensors can be located in multiple locations within a space, such as a room, to detect the location of an occupant within a space. Alternatively, or in addition, the one or more occupant sensors can be attached to the localized HVAC system. For example, the one or more occupant sensors can move with the moveable air delivery system to a plurality of locations withing the space.

The localized HVAC systems disclosed herein can further include a controller 500. As described more fully herein, the controller 500 can be configured to receive data (e.g., from one or more sensor) and output instructions to one or more components (e.g., the fan 114, the movement system 120). For example, the controller can be configured to perform the methods described herein (or any part thereof). The controller 500 can be or include any HVAC control system known in the art, including but not limited to, a dedicated controller for the localized HVAC system, a controller for a central HVAC system, a locally located controller, a remotely located controller (e.g., backend server), and the like, or any combination thereof. Additionally, the controller system can be capable of integrating with a building management system (BMS) or building automation system (BAS). For example, the controller system can communicate with the central HVAC system to relay thermal demand that the one or more sensors of the localized HVAC system measure.

Figure 5:
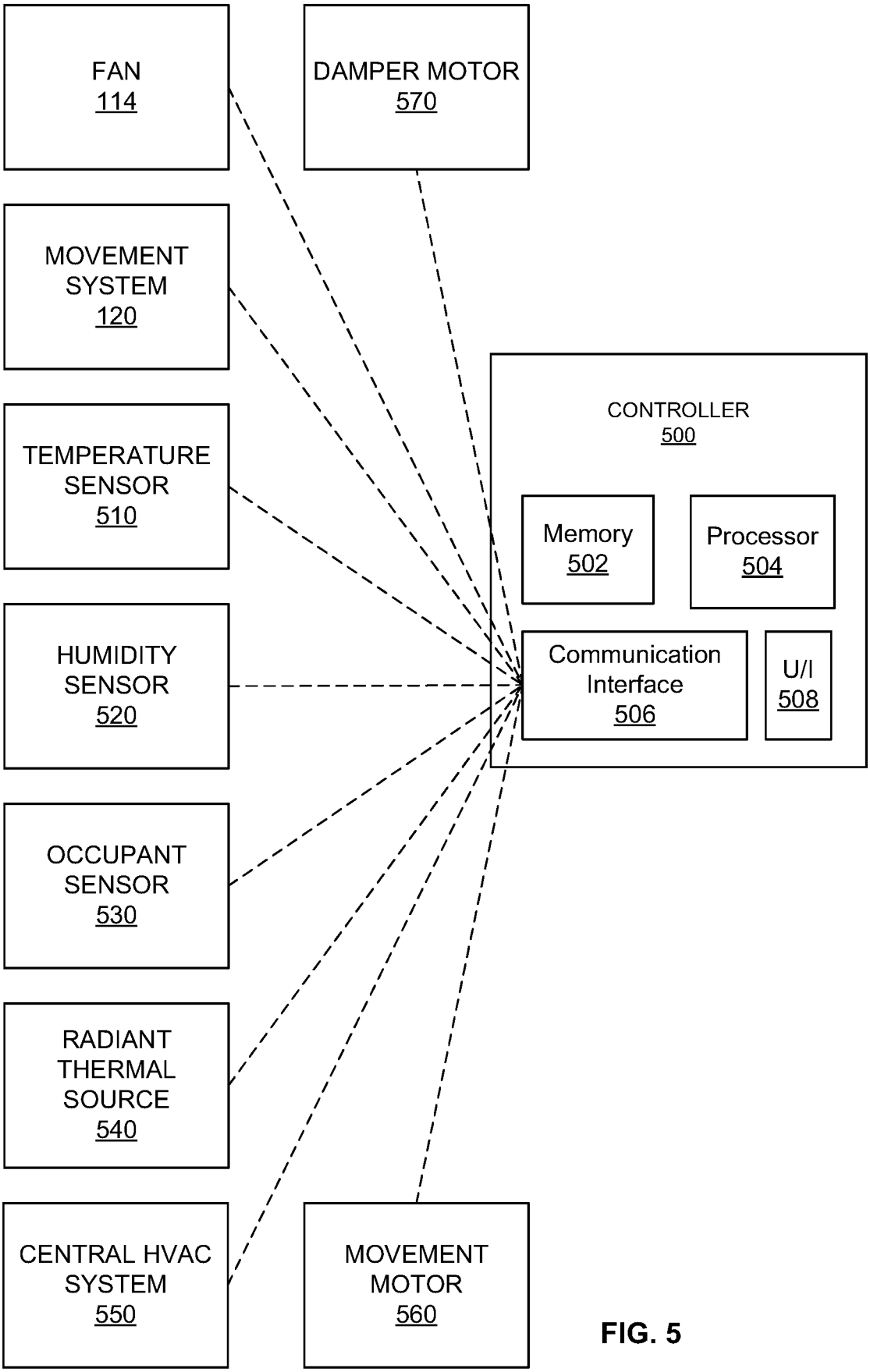
FIG. 5 provides a schematic illustrating an example controller, in accordance with the present disclosure.

As shown in FIG. 5, the controller 500 can include memory 502, a processor 504, a communication interface 506, and/or a user interface 508. The controller 500 can communicate with one or more sensors and/or devices. For example, the controller 500 can receive data from a temperature sensor 510, a humidity sensor 520, and/or an occupant sensor 530. The controller can output instructions to a fan 114, a movement system 120, radiant thermal source 540, a central HVAC system 550, a movement motor 560, and/or a damper motor 570. Additionally, or alternatively, the controller 500 can receive data from the fan 114 (e.g., fan speed), the movement system 120 (e.g., location of moveable air delivery system), the radiant thermal source 540 (e.g., temperature of radiant thermal source), the central HVAC system 550 (e.g., supply air temperature), the movement motor 560 (e.g., current operating mode), and/or the damper motor (e.g., damper position).

Figure 6:
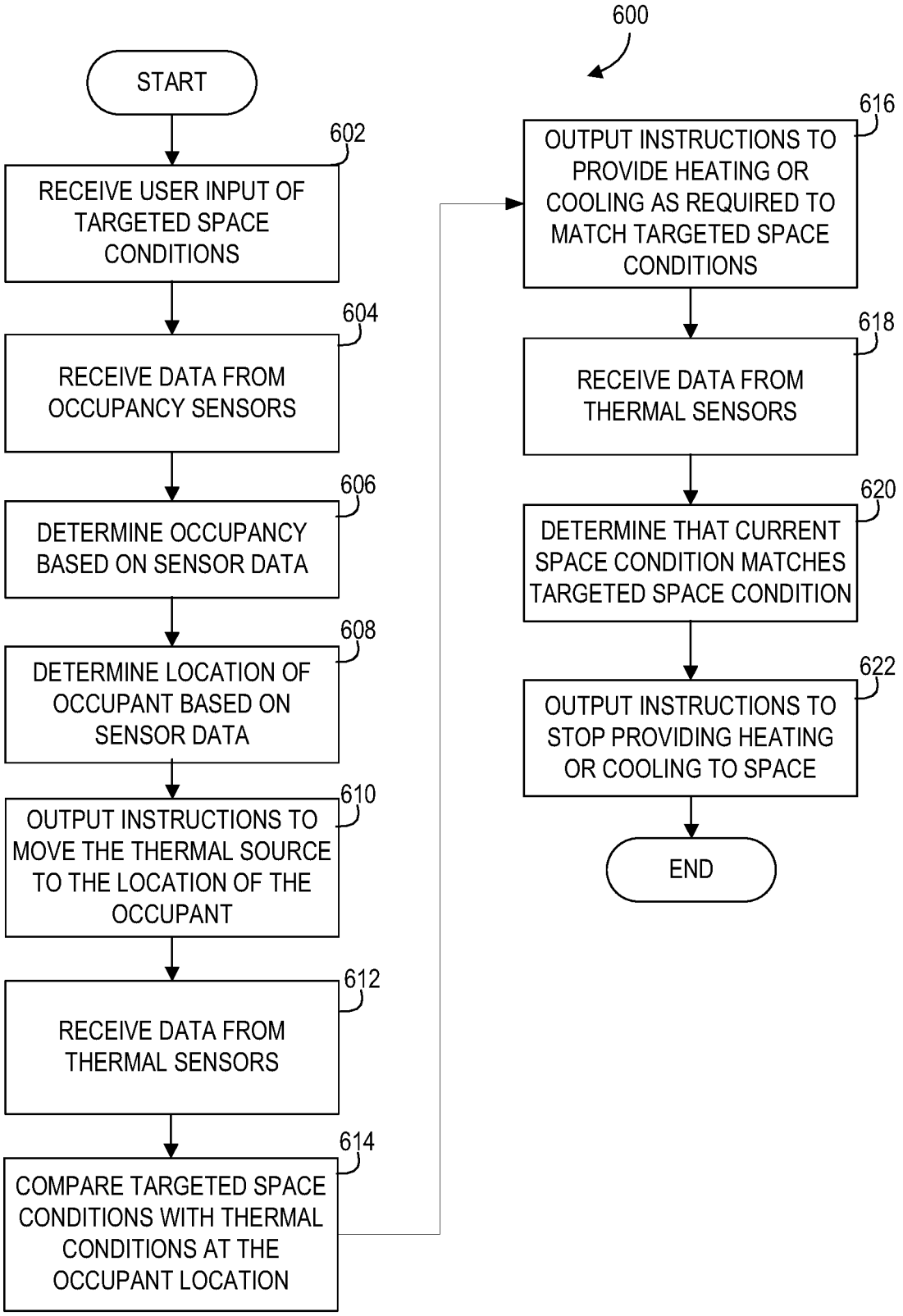
FIG. 6 provides a flow chart illustrating an example method for controlling a localized HVAC system, in accordance with the present disclosure.

The disclosed technology includes methods for controlling a local HVAC system, such as method 600, which is illustrated in FIG. 6. Method 600 and/or any other method described herein can be performed by a controller or computer, such as the controller 500 described herein.

The method 600 can include receiving 602 an input (e.g., from a user) providing the targeted thermal conditions for the space (e.g., the user requested space temperature and/or humidity, within a range of a user requested space temperature and/or humidity, above a minimum space temperature and/or humidity, and/or below a maximum space temperature or humidity). For example, the targeted thermal conditions for the space can include maximum and minimum space temperatures and/or humidity. Optionally, these targeted thermal conditions can differ depending on whether a space is occupied or unoccupied. The user can input the targeted thermal conditions for the space through any means known in the art. For example, the user can input the targeted thermal conditions directly from within the space (e.g., adjusting a thermostat), through a smart thermostat or connected device, through a central building system (e.g., BMS), or through programmed schedules that provide varying targeted thermal condition (e.g., time-dependent targeted thermal conditions per a building occupancy schedule).

The method 600 can include receiving 604 data from one or more sensors or other devices (e.g., an occupancy sensor, a motion sensor). The method 600 can include determining 606, based on the sensor data, that a person is in the room and/or determining 608 the location of the person in the room based on the sensor data. The method 600 can include outputting 610 instructions, based on the location of the person in the room, for the localized HVAC system (e.g., localized HVAC system 100, 200, or 400) to move the moveable air delivery system to a location near the occupant (e.g., to a position that is vertically or laterally aligned with the occupant). For example, the moveable air delivery system can be above a false ceiling and can be moved to a location above the occupant. Alternatively, or in addition, the moveable air delivery system can be behind a false wall and can be moved to a location adjacent to the occupant.

The method 600 can include receiving 612 sensor data from one or more sensors (e.g., a thermostat, a temperature sensor, a humidity sensor, an occupancy sensor). The method 600 can include determining 614, based on the sensor data (e.g., the thermal condition data, occupancy data) and/or the targeted thermal conditions, the load requirement at the location of the person in the room. For example, the method can include comparing the current thermal conditions (e.g., temperature and humidity) at the location surrounding the person in the room with the targeted thermal conditions and determining if any thermal change is required (e.g., heat the area, cool the area).

The method 600 can include outputting 616 instructions for the localized HVAC system to provide heating, cooling, humidifying, dehumidifying, or the like as required to adjust current thermal conditions to match targeted thermal conditions. For example, the method can include outputting instructions for the fan to increase or decrease the airflow. Alternatively, or in addition, the method can include outputting instructions for the supply air temperature and/or humidity to be increased or decreased. For example, the method can include outputting a request and/or instructions for the central HVAC system to provide supply air temperature to the localized HVAC system that has been conditioned (e.g., heated or cooled) and/or provide increased airflow to the localized HVAC (e.g., increase air flow (CFM) of supply air provided to localized HVAC system). Alternatively, or in addition, the method can include outputting instructions for the localized HVAC system to condition the supply air at the localized HVAC system (e.g., through a reheat coil). Alternatively, or in addition, the method can include outputting instructions for the localized HVAC system to modulate the flow (e.g., CFM) of supply airflow to the space, such as by modulating the fan speed. Alternatively, or in addition, the method can include outputting instruction for the localized HVAC system to increase the heating or cooling capacity of the moveable air delivery system, such as by modulating a radiant thermal source (e.g., radiant thermal source 540).

The method 600 can include receiving 618 sensor data from one or more sensors (e.g., a thermostat, a temperature sensor, a humidity sensor, an occupancy sensor). The method 600 can include determining 620, based on the sensor data, whether the current space conditions at the occupant are within the targeted space conditions (e.g., the user requested space temperature and/or humidity, within a range of a user requested space temperature and/or humidity, above a minimum space temperature and/or humidity, and/or below a maximum space temperature or humidity). The method 600 can include outputting 622 instructions for the localized HVAC system to stop providing conditioning to the space in response to determining that the current space conditions at the occupant are within the targeted space conditions.

The method 600 can be executed, repeated, and/or duplicated in whole or in part for spaces with multiple occupants. Additionally, the method 600 can be executed, repeated, and/or duplicated by multiple localized HVAC systems that all serve the same space (e.g., each localized HVAC system services a predetermined portion of the space) and communicate and coordinate to quickly and efficiently address localized thermal demands in the space.

Figure 7:
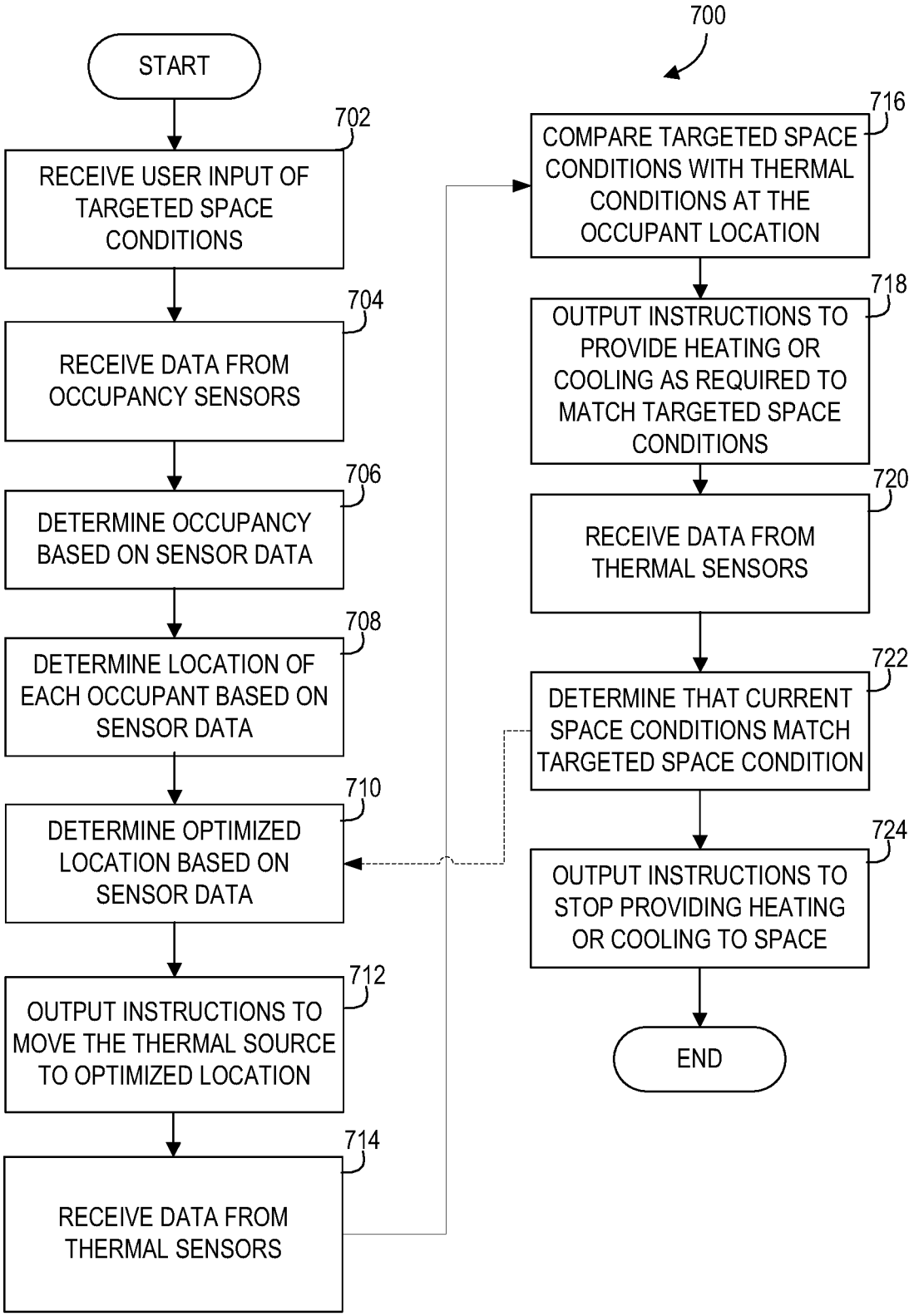
FIG. 7 provides a flow chart illustrating an example method for controlling a localized HVAC system, in accordance with the present disclosure.

The disclosed technology additionally includes method 700 for controlling a local HVAC system, which is illustrated in FIG. 7. Method 700 can relate to controlling a local HVAC system when there is a plurality of occupants within a space. Method 700 and/or any other method described herein can be performed by a controller or computer, such as the controller 500 described herein.

The method 700 can include receiving 702 an input (e.g., from a user) providing the targeted thermal conditions for the space (e.g., the user requested space temperature and/or humidity, within a range of a user requested space temperature and/or humidity, above a minimum space temperature and/or humidity, and/or below a maximum space temperature or humidity). For example, the targeted thermal conditions for the space can include maximum and minimum space temperatures and/or humidity. Optionally, these targeted thermal conditions can differ depending on whether a space is occupied or unoccupied. The user can input the targeted thermal conditions for the space through any means known in the art. For example, the user can input the targeted thermal conditions directly from within the space (e.g., adjusting a thermostat), through a smart thermostat or connected device, through a central building system (e.g., BMS), or through programmed schedules that provide varying targeted thermal condition (e.g., time-dependent targeted thermal conditions per a building occupancy schedule).

The method 700 can include receiving 704 data from one or more sensors or other devices (e.g., an occupancy sensor, a motion sensor, heat signature data). The method 700 can include determining 706, based on the sensor data, that a plurality of occupants are in the room and/or determining 708 the location of each occupant in the room based on sensor data.

The method 700 can include determining 710, based on the respective location for each of the plurality of occupants and sensor data, an optimized location to provide conditioning to best serve the plurality of occupants. For example, the optimized location can be the central location (e.g., centroid, geometric center, approximated center of mass) between the plurality of occupants. As an example, the center of mass for occupants within a room can be approximated by identifying the number and location of the occupants, assuming a standard mass for each occupant, and calculating the approximated center of mass based on the number and location of each occupant and the standard mass for each occupant. Alternatively, or in addition, the optimized location can be a central location between the plurality of occupants based on location and/or thermal conditions. For example, the method 700 can include determining the optimized location by identifying the locations of the plurality of occupants and, optionally, the thermal conditions at each of the locations of the plurality of occupants and, based off these determinations, calculating the optimized location to meet the multiple thermal demands of the space. For example, the optimized location might be closer to one occupant whose surrounding thermal conditions are farther from the targeted thermal conditions of the space when compared to the thermal conditions surrounding the other occupants.

The method 700 can include outputting 712 instructions, e.g., based on the determination of the optimized location, for the localized HVAC system (e.g., localized HVAC system 100, 200, or 400) to move the moveable air delivery system to the optimized location. For example, the method 700 can include outputting instructions for a moveable air delivery system to move to an optimized location above the occupants such as, for example, above a false ceiling. Alternatively, or in addition, the method 700 can include outputting instructions for the moveable air delivery system to move to an optimized location adjacent to the occupants such as, for example, behind a false wall.

The method 700 can include receiving 714 sensor data from one or more sensors (e.g., a thermostat, a temperature sensor, a humidity sensor, an occupancy sensor). The method 700 can include determining 716, based on sensor data (e.g., the thermal condition data, occupancy data) and/or the targeted thermal conditions, the load requirement at the locations of the occupants in the room. For example, the method 700 can include comparing the current thermal conditions (e.g., temperature, humidity) at the location surrounding the plurality of occupants in the room with the targeted thermal conditions and determining if any thermal change is required (e.g., heat the area, cool the area).

The method 700 can include outputting 718 instructions for the localized HVAC system to provide heating, cooling, humidifying, dehumidifying, as required to adjust current thermal conditions to match targeted thermal conditions. For example, the method 700 localized HVAC system can increase the airflow by modulating the fan speed. Alternatively, or in addition, the localized HVAC system can modulate the supply air temperature and humidity. For example, the central HVAC system can, on a request from the localized HVAC system, provide supply air temperature to the localized HVAC system that has been conditioned (e.g., heated or cooled) and/or provide increased airflow to the localized HVAC (e.g., increase air flow (CFM) of supply air provided to localized HVAC system). Alternatively, or in addition, the localized HVAC system can condition the supply air at the localized HVAC system (e.g., through a reheat coil). Alternatively, or in addition, the localized HVAC system can modulate the flow (e.g., CFM) of supply airflow to the space by modulating the fan speed. Alternatively, or in addition, the localized HVAC can increase the heating or cooling capacity of the moveable air delivery system by modulating the radiant thermal source 540.

The method 700 can include receiving 720 sensor data from one or more sensors (e.g., a thermostat, a temperature sensor, a humidity sensor, an occupancy sensor). The method 700 can include determining 722, based on the sensor data, whether the current space conditions at the plurality of occupants are within the targeted space conditions. If it is determined 722, based on the sensor data, that the current space conditions at some, but not all, locations of the plurality of occupants are within the targeted space conditions, the method 700 can include re-determining 710 an optimized location to provide conditioning to best serve the plurality of occupants (e.g., determining a new optimized location) and repeating the succeeding steps in an iterative process until it is determined 722 that the current space conditions at the plurality of occupants are within the targeted space conditions. Once it is determined 722, that the current space conditions at the plurality of occupants are within the targeted space conditions, the method 700 can include outputting 724 instructions for the localized HVAC system to stop providing conditioning to the space.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way.

What is claimed is:

1. A localized heating, ventilation, or air conditioning (HVAC) system comprising:

a moveable air delivery system comprising:

an air inlet configured to receive air; and an air outlet configured to output the air into a space;

a movement system configured to move the air outlet in a generally planar manner, the movement system comprising:

an air delivery support system configured to support the air outlet, the air delivery support system configured to move the air outlet in an air delivery plane, wherein the movement system is configured to move along a generally horizontal plane; and a false ceiling comprising a barrier to substantially separate the movement system from the space, the false ceiling being disposed below the air delivery plane, wherein the false ceiling has one or more openings to allow air to pass from the air outlet of the moveable air delivery system to the space.

2. The localized HVAC system of claim 1, further comprising a fan configured to move the air into the space through the air outlet.

3. The localized HVAC system of claim 1, wherein the movement system further comprises:

a first slider moveable along at least a portion of the air delivery plane in a first linear direction;

a second slider moveable along at least a portion of the air delivery plane in a second linear direction, the second linear direction being generally perpendicular to the first linear direction; and wherein the first and second slider are configured to move the air outlet within the air delivery plane.

4. The localized HVAC system of claim 3, wherein the air delivery support system comprises:

a first track;

a second track;

wherein the first track is configured to guide the first slider along at least a portion of the air delivery plane in the first linear direction; and wherein the second track is configured to guide the second slider along at least a portion of the air delivery plane in the second linear direction.

5. The localized HVAC system of claim 1, wherein the movement system has the air outlet attached thereto, the movement system being configured to move the air outlet between a plurality of locations on the air delivery support system in two degrees of freedom within the air delivery plane.

6. The localized HVAC system of claim 1, wherein the false ceiling further comprises one or more air dampers configured to control air flow from the air outlet of the moveable air delivery system to the space by the one or more air dampers configured to bias closed and the one or more air dampers configured to open when the air outlet of the moveable air delivery system is positioned above the one or more air dampers.

7. The localized HVAC system of claim 1, wherein a second movement system is configured to move along a generally vertical plane.

8. The localized HVAC system of claim 7, further comprising a false wall comprising a second barrier to substantially separate the second movement system from the space, the false wall being disposed adjacent to a second air delivery plane, wherein the false wall has one or more openings to allow air to pass from a second air outlet of the moveable air delivery system to the space.

9. The localized HVAC system of claim 8, wherein the false wall further comprises one or more air dampers configured to control air flow from the second air outlet of the moveable air delivery system to the space by the one or more air dampers configured to bias closed and the one or more air dampers configured to open when the second air outlet of the moveable air delivery system is positioned adjacent to the one or more air dampers.

10. The localized HVAC system of claim 1, further comprising a controller configured to move the air outlet within the air delivery plane.

11. The localized HVAC system of claim 1, further comprising a sensor.

12. The localized HVAC system of claim 11, further comprising a controller configured to:

receive user location data from the sensor, the user location data indicating a current location of a user in the space;

determine a position corresponding to the current location of a user in the space; and output instructing for the movement system to move the air outlet to the position.

13. The localized HVAC system of claim 1, wherein the air inlet is configured to receive air from through a duct.

14. The localized HVAC system of claim 1, wherein the air inlet is configured to receive air through a pressurized plenum.

15. A localized heating, ventilation, or air conditioning (HVAC) system comprising:

a first moveable air delivery system comprising:

a first air inlet configured to receive air; and a first air outlet configured to output the air into a space; and a first movement system configured to move the first air outlet in a generally planar manner, the first movement system comprising:

a first air delivery support system configured to support the first air outlet, the first air delivery support system configured to move the first air outlet in a generally horizontal air delivery plane;

a second moveable air delivery system comprising:

a second air inlet configured to receive air; and a second air outlet configured to output the air into a space; and a second movement system configured to move the second air outlet in a generally planar manner, the second movement system comprising:

a second air delivery support system configured to support the second air outlet, the second air delivery support system configured to move the second air outlet in a generally vertical air delivery plane.

16. A localized heating, ventilation, or air conditioning (HVAC) system comprising:

a moveable air delivery system comprising:

an air inlet configured to receive air; and an air outlet configured to output the air into a space;

a movement system configured to move the air outlet in a generally planar manner, the movement system comprising:

an air delivery support system configured to support the air outlet, the air delivery support system configured to move the air outlet in an air delivery plane, wherein the movement system is configured to move along a generally vertical plane; and a false wall comprising a barrier to substantially separate the movement system from the space, the false wall being disposed adjacent to the air delivery plane, wherein the false wall has one or more openings to allow air to pass from the air outlet of the moveable air delivery system to the space.

17. The localized HVAC system of claim 16, wherein the false wall further comprises one or more air dampers configured to control air flow from the air outlet of the moveable air delivery system to the space by the one or more air dampers configured to bias closed and the one or more air dampers configured to open when the air outlet of the moveable air delivery system is positioned adjacent to the one or more air dampers.

* * * * *